US009415914B2

(12) United States Patent
Holley, Jr.

(10) Patent No.: US 9,415,914 B2
(45) Date of Patent: Aug. 16, 2016

(54) CARRIER FOR CONTAINERS

(71) Applicant: Graphic Packaging International, Inc., Atlanta, GA (US)

(72) Inventor: John Murdick Holley, Jr., Lawrenceville, GA (US)

(73) Assignee: Graphic Packaging International, Inc., Atlanta, GA (US)

( * ) Notice: Subject to any disclaimer, the term of this patent is extended or adjusted under 35 U.S.C. 154(b) by 0 days.

(21) Appl. No.: 14/707,157

(22) Filed: May 8, 2015

(65) Prior Publication Data

US 2015/0321816 A1 Nov. 12, 2015

Related U.S. Application Data

(60) Provisional application No. 61/996,512, filed on May 9, 2014.

(51) Int. Cl.
*B65D 71/58* (2006.01)
*B65D 71/56* (2006.01)

(52) U.S. Cl.
CPC ..... *B65D 71/0014* (2013.01); *B65D 71/0022* (2013.01); *B65D 2571/0045* (2013.01); *B65D 2571/0066* (2013.01); *B65D 2571/00141* (2013.01); *B65D 2571/00308* (2013.01); *B65D 2571/00388* (2013.01); *B65D 2571/00456* (2013.01); *B65D 2571/00487* (2013.01);
(Continued)

(58) Field of Classification Search
CPC ..... B65D 71/0022; B65D 2571/00487; B65D 2571/0066; B65D 2571/00419; B65D 2571/00358
USPC ..... 229/120.12, 117.09, 117.14, 120.14, 229/120.23, 934; 206/188, 193, 162, 173, 206/170, 174; 220/557, 771
See application file for complete search history.

(56) References Cited

U.S. PATENT DOCUMENTS 2,222,211 A 11/1940 Arneson
2,225,822 A 12/1940 Crook
(Continued)

FOREIGN PATENT DOCUMENTS

DE 90 04 439 6/1990
EP 0 822 150 A1 2/1998
(Continued)

OTHER PUBLICATIONS

International Search Report and Written Opinion for PCT/US2015/029826 dated Aug. 18, 2015.

*Primary Examiner* — Christopher Demeree
(74) *Attorney, Agent, or Firm* — Womble Carlyle Sandridge & Rice, LLP

(57) ABSTRACT

A carrier for holding a plurality of containers. The carrier includes a plurality of panels that extends at least partially around an interior of the carrier. The panels comprise at least one bottom panel, a front panel, a back panel, and at least two side panels. The carrier includes at least one central panel dividing the interior of the carrier into a front portion and a back portion and at least one divider flap foldably attached to the at least one central panel. The at least one divider flap extends to one of the front panel and the back panel to divide one of the front portion and the back portion into at least two container-receiving spaces. The at least one divider flap having a main panel foldably connected to the at least one central panel. At least one beveled portion is foldably connected to the main panel.

27 Claims, 14 Drawing Sheets

(52) U.S. Cl.
CPC ..... *B65D2571/00549* (2013.01); *B65D 2571/00783* (2013.01)

(56) References Cited

U.S. PATENT DOCUMENTS 2,227,330 A 12/1940 Turner
2,331,312 A 10/1943 Dorfman
2,336,857 A 12/1943 Gies et al.
2,457,308 A 12/1948 Hall et al.
2,460,108 A 1/1949 Smith et al.
2,660,361 A 11/1953 Tyrseck
2,689,061 A 9/1954 Gray
2,721,001 A 10/1955 Hasselhoff
2,772,020 A 11/1956 Kramer
2,776,072 A 1/1957 Forrer
2,783,916 A 3/1957 Hodapp
2,991,908 A 7/1961 Conescu
2,993,619 A 7/1961 Arneson
3,029,977 A 4/1962 Arneson
3,053,411 A 9/1962 Struble et al.
3,128,906 A 4/1964 Forrer
3,190,487 A 6/1965 Wood
3,191,800 A 6/1965 Kowal
3,194,478 A 7/1965 Weiss
3,229,849 A 1/1966 Spillson
3,236,414 A 2/1966 Slevin, Jr.
3,313,466 A 4/1967 Keith
3,343,742 A 9/1967 Siegler
3,352,452 A 11/1967 Graser
3,432,073 A 3/1969 Forrer
3,554,401 A 1/1971 Wood
3,624,790 A 11/1971 Stout
3,651,982 A * 3/1972 Slevin ..... B65D 71/0022 206/173
3,661,297 A 5/1972 Wood
3,669,306 A 6/1972 Forrer
3,672,539 A 6/1972 Forrer
3,709,400 A 1/1973 Arneson
3,721,335 A 3/1973 Grant
3,722,738 A 3/1973 Wright
3,739,940 A * 6/1973 Harrelson ..... B65D 71/0022 206/173
3,754,680 A 8/1973 Wood
3,757,991 A * 9/1973 Stout ..... B65D 71/0022 206/173
3,784,053 A 1/1974 Stout
3,860,113 A 1/1975 Helms
3,893,565 A 7/1975 Rossi et al.
3,917,059 A 11/1975 Wood
3,917,060 A 11/1975 Wood
3,917,061 A 11/1975 Stout
4,000,813 A 1/1977 Stout
4,010,847 A 3/1977 Wood et al.
4,029,205 A 6/1977 Wood
4,153,158 A 5/1979 Graser et al.
4,171,046 A 10/1979 Bonczyk
4,187,944 A 2/1980 Wood
4,205,748 A 6/1980 Wilson
4,217,983 A 8/1980 Stout
4,243,138 A 1/1981 Wilson
4,250,992 A 2/1981 Gilbert
4,253,564 A 3/1981 Engdahl, Jr.
4,308,950 A 1/1982 Wood
4,318,470 A 3/1982 Montealegre
4,319,682 A 3/1982 Wright et al.
4,362,240 A 12/1982 Elward
4,374,561 A 2/1983 Stout et al.
4,377,252 A 3/1983 Schillinger
4,406,365 A 9/1983 Kulig
4,413,729 A 11/1983 Wood
4,450,956 A 5/1984 Wood
4,469,222 A 9/1984 Graser
4,480,746 A 11/1984 Wood
4,482,055 A 11/1984 Boyle
4,509,640 A 4/1985 Joyce
4,544,092 A 10/1985 Palmer
4,591,090 A 5/1986 Collins et al.
4,610,349 A 9/1986 Schwartz et al.
4,722,437 A 2/1988 Walsh
4,770,294 A 9/1988 Graser
4,782,943 A 11/1988 Blackman
4,782,944 A 11/1988 Engdahl, Jr.
4,792,038 A 12/1988 Cooper
4,927,009 A 5/1990 Stout
5,029,698 A 7/1991 Stout
5,040,672 A 8/1991 DeMaio et al.
5,072,876 A 12/1991 Wilson
5,123,588 A 6/1992 Harris
5,161,732 A 11/1992 Clein et al.
5,167,325 A 12/1992 Sykora
5,191,976 A 3/1993 Stout et al.
5,246,113 A 9/1993 Schuster
5,282,348 A 2/1994 Dampier et al.
5,359,830 A 11/1994 Olson et al.
5,363,954 A 11/1994 Dampier et al.
5,400,901 A 3/1995 Harrelson
5,439,110 A 8/1995 Regan, II
5,458,234 A 10/1995 Harris
5,482,203 A 1/1996 Stout
5,484,053 A 1/1996 Harris
5,499,712 A 3/1996 Harrelson
5,518,110 A 5/1996 Harrelson
5,531,319 A 7/1996 Harrelson
5,538,130 A 7/1996 Harrelson
5,538,131 A 7/1996 Harrelson
5,547,074 A 8/1996 Plaxico et al.
5,579,625 A 12/1996 Olson et al.
5,590,762 A 1/1997 Harrelson
5,593,027 A 1/1997 Sutherland
5,611,425 A 3/1997 Holley, Jr.
5,620,094 A 4/1997 Naumann
5,638,956 A 6/1997 Sutherland
5,645,162 A 7/1997 Harrelson
5,649,620 A 7/1997 Harrelson
5,657,864 A 8/1997 Harrelson
5,657,865 A 8/1997 Harrelson
5,680,930 A 10/1997 Stone
5,682,982 A 11/1997 Stonehouse
5,682,985 A 11/1997 Plaxico et al.
5,695,051 A 12/1997 Hart
5,709,298 A 1/1998 Harris
5,765,685 A 6/1998 Roosa
5,775,487 A 7/1998 Harrelson
5,819,920 A 10/1998 Sutherland
5,848,695 A 12/1998 Harris et al.
5,855,316 A 1/1999 Spivey
5,871,090 A 2/1999 Doucette et al.
5,878,877 A 3/1999 Sutherland
5,884,756 A 3/1999 Holley, Jr. et al.
5,941,377 A 8/1999 Hart et al.
5,947,273 A 9/1999 Dalrymple et al.
6,003,665 A 12/1999 Stout
6,041,920 A 3/2000 Hart et al.
6,112,977 A 9/2000 Sutherland et al.
6,131,729 A 10/2000 Eckermann et al.
6,155,962 A 12/2000 Dalrymple et al.
6,168,013 B1 1/2001 Gomes
6,230,881 B1 5/2001 Collura
6,247,585 B1 6/2001 Holley, Jr.
6,315,111 B1 11/2001 Sutherland
6,321,906 B1 11/2001 Wein
6,341,689 B1 1/2002 Jones
6,371,287 B1 4/2002 Jones et al.
6,571,941 B2 6/2003 Holley, Jr.
6,695,137 B2 2/2004 Jones et al.
6,736,260 B2 5/2004 Gomes et al.
6,802,802 B2 10/2004 Woog
6,814,228 B2 11/2004 Sutherland
6,938,756 B2 9/2005 Schuster
7,011,209 B2 3/2006 Sutherland et al.
7,025,197 B2 4/2006 Sutherland
7,070,045 B2 7/2006 Theelen
7,128,206 B2 10/2006 Kohler
7,134,547 B2 11/2006 Auclair

(56) References Cited

U.S. PATENT DOCUMENTS

| | | | |
|---|---|---|---|
| 7,207,934 | B2 | 4/2007 | Schuster |
| 7,234,596 | B2 | 6/2007 | Lebras |
| 7,374,038 | B2 | 5/2008 | Smalley |
| 7,448,492 | B2 | 11/2008 | Sutherland |
| 7,472,791 | B2 | 1/2009 | Spivey, Sr. |
| 7,552,820 | B2 | 6/2009 | Kohler |
| 7,604,116 | B2 | 10/2009 | Schuster |
| 7,644,817 | B2 | 1/2010 | Sutherland |
| 7,677,387 | B2 | 3/2010 | Brand et al. |
| 7,762,395 | B2 | 7/2010 | Sutherland et al. |
| 7,762,397 | B2 | 7/2010 | Coltri-Johnson et al. |
| 7,793,780 | B2 | 9/2010 | Smalley |
| 7,959,062 | B2 | 6/2011 | Auclair |
| 8,020,695 | B2 | 9/2011 | Brand |
| 8,297,437 | B2 | 10/2012 | Smalley et al. |
| 8,622,207 | B2 | 1/2014 | Smalley |
| 2002/0077236 | A1 | 6/2002 | Chalendar et al. |
| 2002/0117407 | A1 | 8/2002 | Holley |
| 2003/0111363 | A1 | 6/2003 | Theelen |
| 2003/0159950 | A1 | 8/2003 | Jones et al. |
| 2003/0213705 | A1 | 11/2003 | Woog |
| 2004/0026269 | A1 | 2/2004 | Cuomo |
| 2004/0050722 | A1 | 3/2004 | Schuster |
| 2004/0094435 | A1 | 5/2004 | Auclair et al. |
| 2005/0167292 | A1 | 8/2005 | Sutherland |
| 2005/0211577 | A1 | 9/2005 | Bakx |
| 2005/0218014 | A1 | 10/2005 | Schuster |
| 2005/0230273 | A1 | 10/2005 | Kohler |
| 2006/0091024 | A1 | 5/2006 | Cuomo |
| 2006/0148629 | A1 | 7/2006 | Cuomo |
| 2006/0157545 | A1 | 7/2006 | Auclair |
| 2006/0231440 | A1 | 10/2006 | Holley, Jr. |
| 2007/0000980 | A1 | 1/2007 | Oliveira |
| 2007/0017839 | A1 | 1/2007 | Sutherland |
| 2007/0029212 | A1 | 2/2007 | Smalley |
| 2007/0151873 | A1 | 7/2007 | Schuster |
| 2008/0210581 | A1 | 9/2008 | Brand |
| 2008/0265008 | A1 | 10/2008 | Holley |
| 2009/0008273 | A1 | 1/2009 | Smalley |
| 2010/0006458 | A1 | 1/2010 | Wilkins et al. |
| 2010/0072086 | A1 | 3/2010 | Smalley |
| 2011/0048975 | A1 | 3/2011 | Brand |
| 2012/0000913 | A1 | 1/2012 | Smalley et al. |
| 2014/0291386 | A1 | 10/2014 | Ikeda |

FOREIGN PATENT DOCUMENTS

| | | |
|---|---|---|
| EP | 1 319 607 | 6/2003 |
| EP | 1 852 359 | 11/2007 |
| EP | 2 102 073 | 9/2010 |
| FR | 2 825 074 | 11/2002 |
| GB | 926874 | 5/1963 |
| WO | WO 97/05026 | 2/1997 |
| WO | WO 99/01356 | 1/1999 |
| WO | WO 2006/020525 | 2/2006 |
| WO | WO 2008/089124 | 7/2008 |

* cited by examiner

CARRIER FOR CONTAINERS

CROSS-REFERENCE TO RELATED APPLICATIONS

This application claims the benefit of U.S. Provisional Patent Application No. 61/996,512, filed May 9, 2014.

INCORPORATION BY REFERENCE

The disclosure of U.S. Provisional Patent Application No. 61/996,512, which was filed May 9, 2014, is hereby incorporated by reference as if presented herein in its entirety.

BACKGROUND OF THE DISCLOSURE

The present disclosure generally relates to carriers or cartons for holding and displaying containers. More specifically, the present disclosure relates to basket-style carriers.

SUMMARY OF THE DISCLOSURE

In general, one aspect of the disclosure is directed to a carrier for holding a plurality of containers. The carrier includes a plurality of panels that extends at least partially around an interior of the carrier. The panels comprise at least one bottom panel, a front panel, a back panel, and at least two side panels. The carrier includes at least one central panel dividing the interior of the carrier into a front portion and a back portion and at least one divider flap foldably attached to the at least one central panel. The at least one divider flap extends to one of the front panel and the back panel to divide one of the front portion and the back portion into at least two container-receiving spaces. The at least one divider flap having a main panel foldably connected to the at least one central panel. At least one beveled portion is foldably connected to the main panel and oblique to the main portion panel.

In another aspect, the disclosure is generally directed to a blank for forming a carrier for holding a plurality of containers. The blank comprises a plurality of panels. The plurality of panels include at least one bottom panel, a front panel, a back panel, and at least two side panels. The blank further comprises at least one central panel configured to divide the interior of the carrier into a front portion and a back portion when the carrier is formed from the blank. At least one divider flap is foldably attached to the at least one central panel. The at least one divider flap is configured to extend to one of the front panel and the back panel to divide one of the front portion and the back portion into at least two container-receiving spaces when the carrier is formed from the blank. The at least one divider flap has a main panel foldably connected to the at least one central panel. At least one beveled portion is foldably connected to the main panel and oblique to the main portion panel when the carrier is formed from the blank.

In another aspect, the disclosure is generally directed to a method of forming a carrier for containing a plurality of containers. The method comprises obtaining a blank comprising at least one bottom panel, a front panel, a back panel, at least two side panels, at least one central panel, and at least one divider flap foldably attached to the at least one central panel. The at least one divider flap has a main panel foldably connected to the at least one central panel, and at least one beveled portion foldably connected to the main panel. The method further comprises forming the interior and dividing the interior into a front portion and a back portion with the at least one central panel. The method further comprises dividing one of the front portion and the back portion into at least two container receiving spaces by positioning the at least one divider flap so that the at least one divider flap extends to a respective one of the front and back panels.

BRIEF DESCRIPTION OF THE DRAWINGS

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

According to common practice, the various features of the drawings discussed below are not necessarily drawn to scale. Dimensions of various features and elements in the drawings may be expanded or reduced to more clearly illustrate the embodiments of the disclosure.

DETAILED DESCRIPTION OF THE EXEMPLARY EMBODIMENT

The present disclosure generally relates to carriers, packages, constructs, sleeves, cartons, or the like, for holding and displaying containers such as jars, bottles, cans, etc. The containers can be used for packaging food and beverage products, for example. The containers can be made from materials suitable in composition for packaging the particular food or beverage item, and the materials include, but are not limited to, plastics such as PET, LDPE, LLDPE, HDPE, PP, PS, PVC, EVOH, and Nylon; and the like; aluminum and/or other metals; glass; or any combination thereof.

Carriers according to the present disclosure can accommodate containers of numerous different shapes. For the purpose of illustration and not for the purpose of limiting the scope of the disclosure, the following detailed description describes beverage containers (e.g., glass bottles or plastic containers) at least partially disposed within the carrier embodiments. In this specification, the terms “lower,” “bottom,” “upper,” “top,” “front,” and “back” indicate orientations determined in relation to fully erected carriers.

Figure 1:
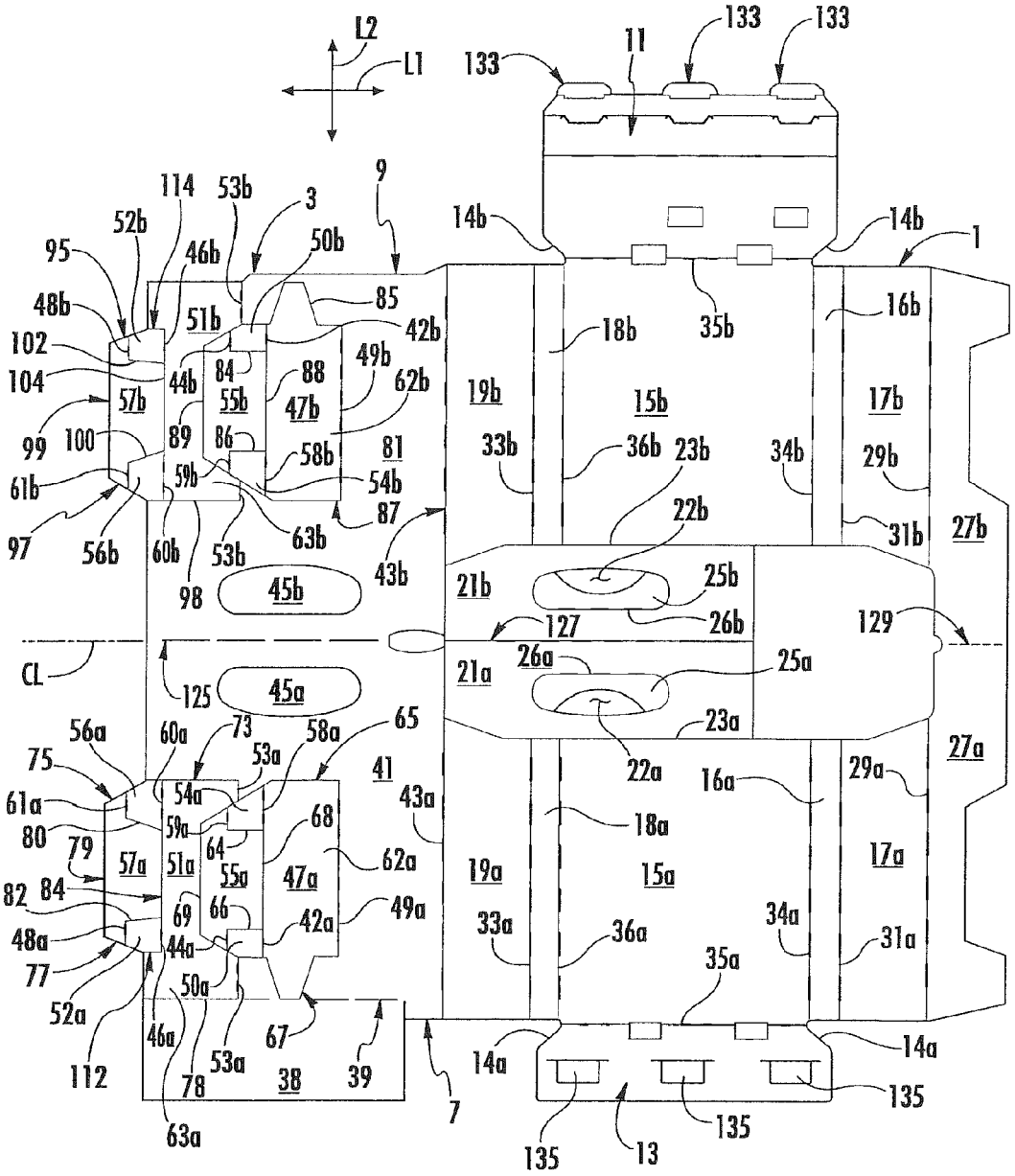
FIG. 1 is a plan view of an exterior of a carton blank used to form an exemplary basket-style carrier according to one embodiment of the disclosure.
Figure 10:
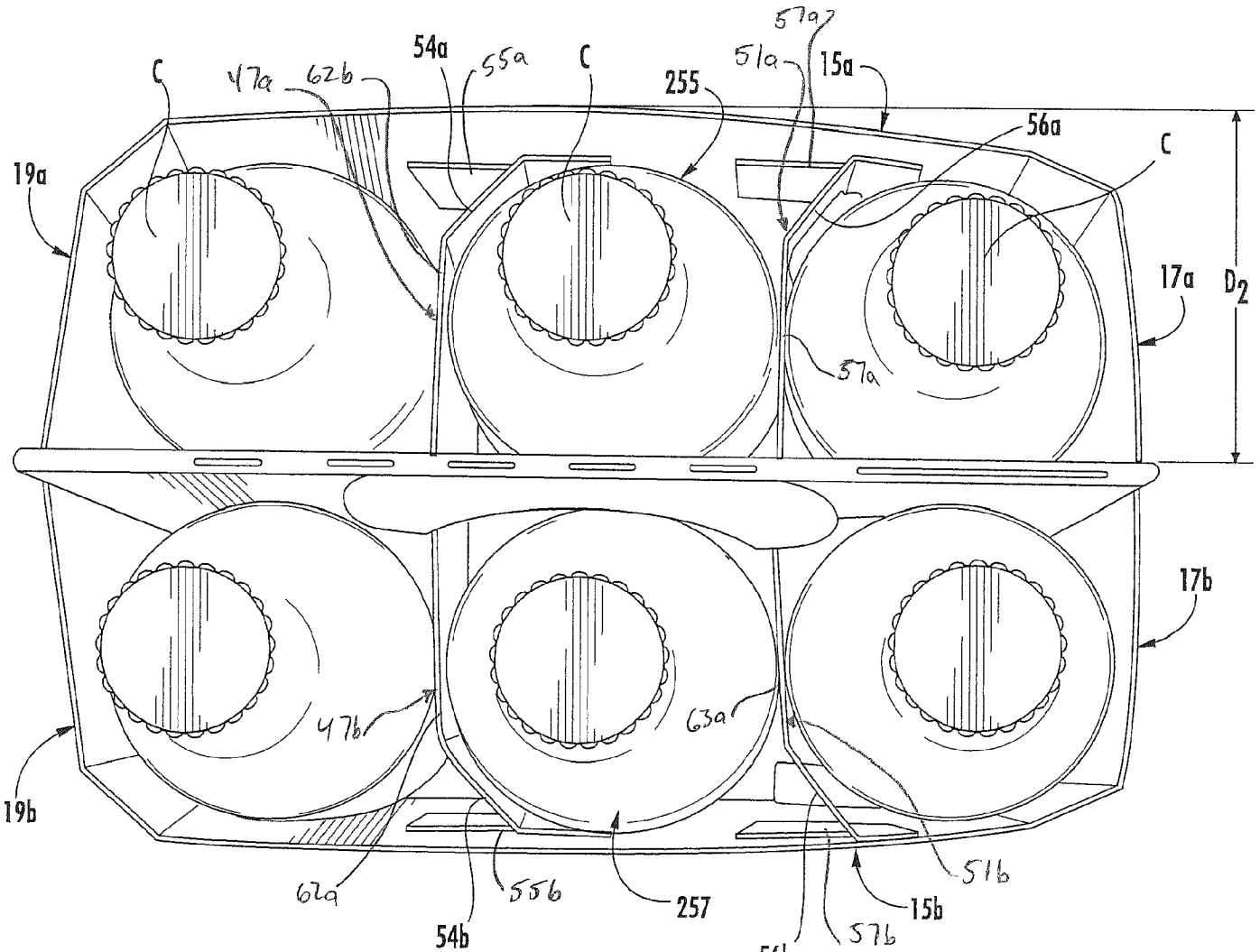
Figure 13:
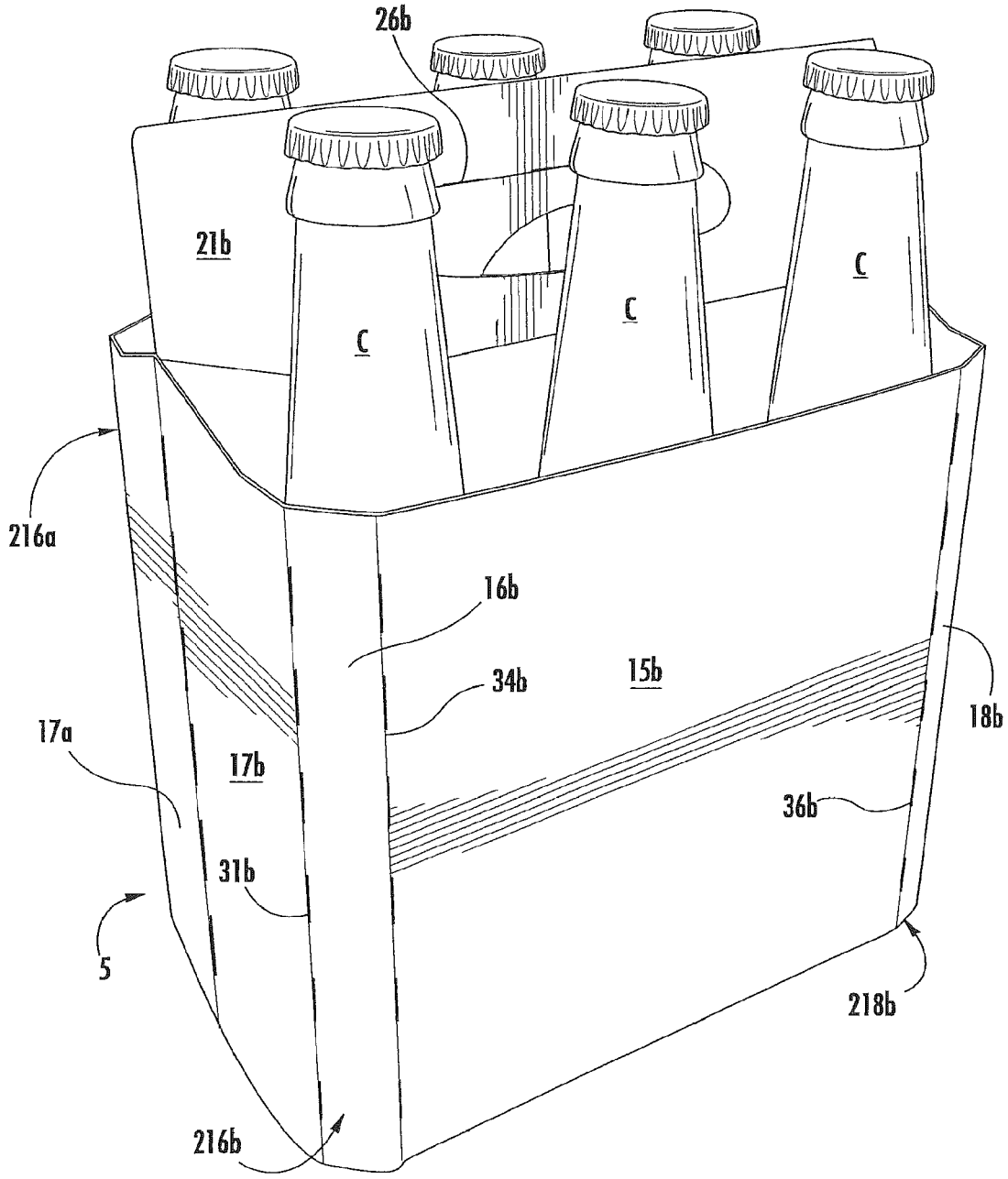
FIG. 13 is a perspective of the erected carrier according to one embodiment of the disclosure.
Figure 14:
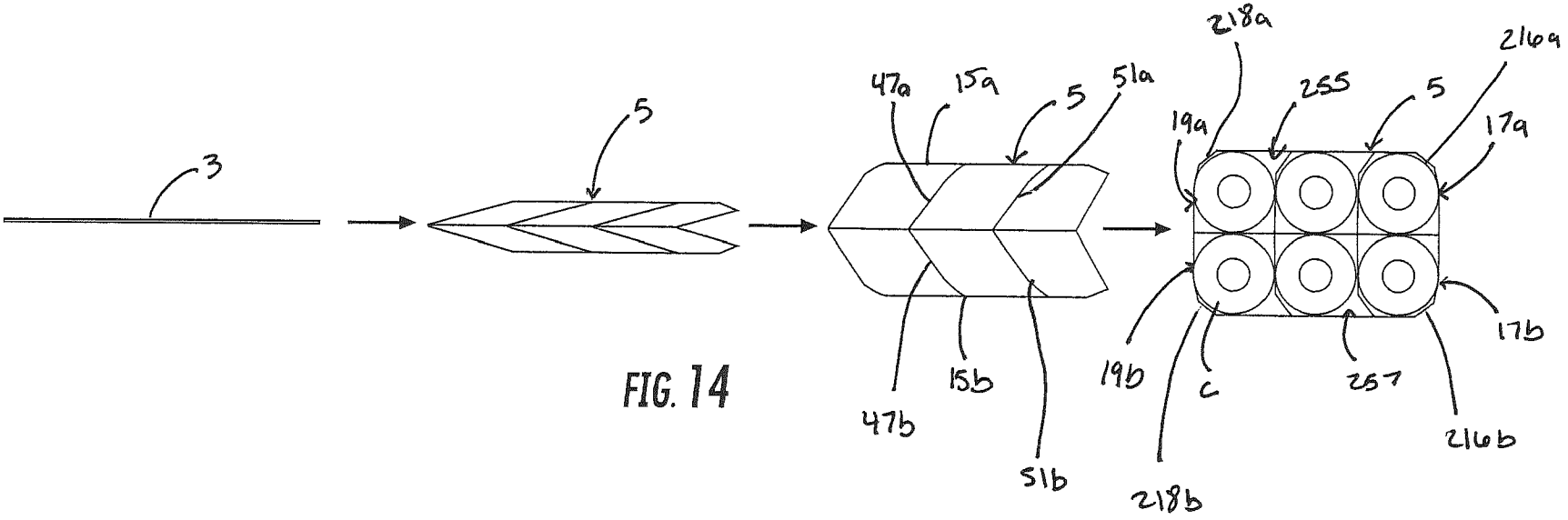
FIG. 14 is an illustration of the carrier opening process according to one embodiment of the disclosure. Corresponding parts are designated by corresponding reference numbers throughout the drawings.

FIG. 1 is a plan view of an exterior side 1 of a blank 3 used to form a package or basket-style carrier 5 (FIG. 13), in accordance with an exemplary embodiment of the present disclosure. As shown in FIGS. 10 and 13, the carrier 5 is sized to contain six containers C, three containers being contained in a front portion of the carrier and three containers being contained in a back portion of the carrier. The carrier may be sized and shaped to hold more or less than six containers.

The blank 3 has a longitudinal axis L1 and a lateral axis L2. The blank 3 has a front portion 7, a back portion 9, a bottom panel 11 foldably connected to the back portion, and a bottom adhesive flap 13 foldably connected to the front portion. In the illustrated embodiment, the front portion 7 and back portion 9 are for being folded about a longitudinal centerline CL when the blank 3 is formed into the carrier 5. As illustrated in FIG. 1 adhesive flap 13 and bottom panel 11 respectively have beveled corners 14*a*, 14*b* to facilitate forming beveled corners of the carrier when the carrier 5 is formed from the blank. The bottom panel 11 and the adhesive flap 13 may be oppositely arranged without departing from the disclosure. As discussed in more detail below, the blank 3 is formed into the carrier 5 by folding the blank about the centerline CL so that the front portion 7 and the back portion 9 are overlapped.

In the illustrated embodiment, the front portion 7, comprises a front panel 15*a* foldably connected to a first front corner panel 16*a* and a second front corner panel 18*a*. The first front corner panel 16*a* is foldably connected to a first side panel 17*a* and the second front corner panel 18*a* is foldably connected to a second side panel 19*a*. The front portion 7 includes a front handle panel 21*a* adjacent the first side panel 17*a* and second side panel 19*a*. The front handle panel 21*a* is separated from the front panel 15*a*, the second front corner panel 18*a*, and the second side panel 19*a* by a cut 23*a*. The front handle panel 21*a* includes a handle opening 22*a* and a handle flap 25*a* foldably connected to the front handle panel at a lateral fold line 26*a*. A central panel flap 27*a* is foldably connected to the first side panel 17*a* at a lateral fold line 29*a*. Lateral fold lines 31*a*, 33*a*, foldably connect respective first and second side panel 17*a*, 19*a* to first and second front corner panels 16*a*, 18*a*. Lateral fold lines 34*a*, 36*a* foldably connect a respective first and second front corner panel 16*a*, 18*a* to the front panel 15*a*. A longitudinal fold line 35*a* connects the bottom panel adhesive flap 13 to the front panel 15*a*.

In the illustrated embodiment, the features of the back portion 9 of the blank 3 include a back panel 15*b*, third side panel 17*b*, fourth side panel 19*b*, a first back corner panel 16*b*, a second back corner panel 18*b*, back handle panel 21*b*, and central panel flap 27*b* that are generally a mirror-image of the corresponding panel or flap of the front portion 7. Corresponding components (e.g., panels, flaps, fold lines, cuts, etc.) have been designated by corresponding reference numbers that differ by the "a" or "b" suffix, with the "a" components corresponding to the front portion 7 and the "b" components corresponding to the back portion 9 of the blank 3.

In one embodiment, the front portion 7 includes a front or first central panel 41 foldably connected to the second side panel 19*a* at a lateral fold line 43*a*. The central panel 41 includes a handle opening 45*a* and a keel 38 foldably connected to the central panel 41 at a longitudinal fold line 39. A first divider flap 47*a* is foldably connected to the front central panel 41 at a lateral fold line 49*a*. A second divider flap 51*a* is foldably connected to the front central panel 41 at a lateral fold line 53*a*. Each divider flap 47*a*, 51*a* includes a main portion 62*a*, 63*a* and beveled portions 50*a*, 54*a* and 52*a*, 56*a* foldably connected to the main portions of the respective divider flap at lateral fold lines 42*a*, 58*a* and 46*a*, 60*a*. Each beveled portion 50*a*, 54*a*, 52*a*, 56*a* includes a respective attachment flap 55*a*, 57*a* foldably connected to the respective beveled portion of the respective divider flap at a lateral fold line 44*a*, 59*a*, 48*a*, 61*a*. The first divider flap 47*a* is at least partially defined by an upper cut 65, a lower cut 67, a lateral cut 69, and the lateral fold line 49*a*. The first attachment flap 55*a* is at least partially defined by upper cuts 64, 65; lower cuts 66, 67; lateral cuts 68, 69; and lateral fold lines 44*a*, 59*a*. The second divider flap 51*a* is at least partially defined by an upper cut 73 that extend from a lateral edge of the blank 3 to the fold line 53*a*, an upper edge 75, an lower cut 78 that extend from a lateral edge of the blank 3 to the fold line 53*a*, a lower edge 77, a lateral edge 79 corresponding to a lateral edge of the blank, and the lateral fold line 53*a*. The second attachment flap 57*a* is at least partially defined by an upper cut 80, an upper edge 75, a lower cut 82, a lower edge 77, a lateral cut 84, a lateral edge 79, and lateral fold lines 48*a*, 61*a*, The bevel portion 52*a* of the second divider flap 51*a* is at least partially defined by an upper cut 82, a lower cut 112, lower edge 77, and lateral fold lines 46*a*, 48*a*.

The back portion 9 includes a back or second central panel 81 foldably connected to the fourth side panel 19*b* at a lateral fold line 43*b*. The central panel 81 includes a handle opening 45*b*. A third divider flap 47*b* is foldably connected to the back central panel 81 at a lateral fold line 49*b*. A fourth divider flap 51*b* is foldably connected to the back central panel 81 at a lateral fold line 53*b*. Each divider flap 47*b*, 51*b* includes a main portion 62*b*, 63*b* and beveled portions 50*b*, 54*b* and 52*b*, 56*b* foldably connected to the main portions of the divider flap at lateral fold lines 42*b*, 58*b* and 46*b*, 60*b*. Each beveled portion 50*b*, 54*b* and 52*b*, 56*b* includes a respective adhesive flap 55*b*, 57*b* foldably connected to the bevel portions of the respective divider flap at lateral fold lines 44*b*, 59*b* and 48*b*, 61*b*. The third divider flap 47*b* is at least partially defined by an upper cut 87, a lower cut 85, a lateral cut 89, and the lateral fold line 49*b*. The third attachment flap 55*b* is at least partially defined by lower cuts 84, 85; upper cuts 86, 87; lateral cuts 89, 88; and lateral fold lines 44*b*, 59*b*. The fourth divider flap 51*b* is at least partially defined by an upper cut 98 that extend from a lateral edge of the blank 3 to the fold line 53*b*, an upper edge 97, a lower edge 95, a lateral edge 99 corresponding to a lateral edge of the blank, and the lateral fold line 53*b*. The fourth attachment flap 57*b* is at least partially defined by an upper cut 100, an upper edge 97, a lower cut 102, a lower edge 95, a lateral cut 104, a lateral edge 99, and lateral fold lines 48*b*, 61*b*. The bevel portion 52*b* of the second divider flap 51*b* is at least partially defined by an upper cut 102, a lower cut 114, lower edge 95, and lateral fold lines 46*b*, 48*b*.

In the illustrated embodiment, the blank 3 includes a longitudinal fold line 125 that foldably connects the front central panel 41 and the back central panel 81. Also, a longitudinal fold line 127 foldably connects the front handle panel 21*a* and the back handle panel 21*b*. A longitudinal fold line 129 foldably connects the front central panel flap 27*a* and the rear central panel flap 27*b*. In the illustrated embodiment, the longitudinal fold lines 125, 127, 129 are aligned with the longitudinal centerline CL of the blank 3.

Figure 2:
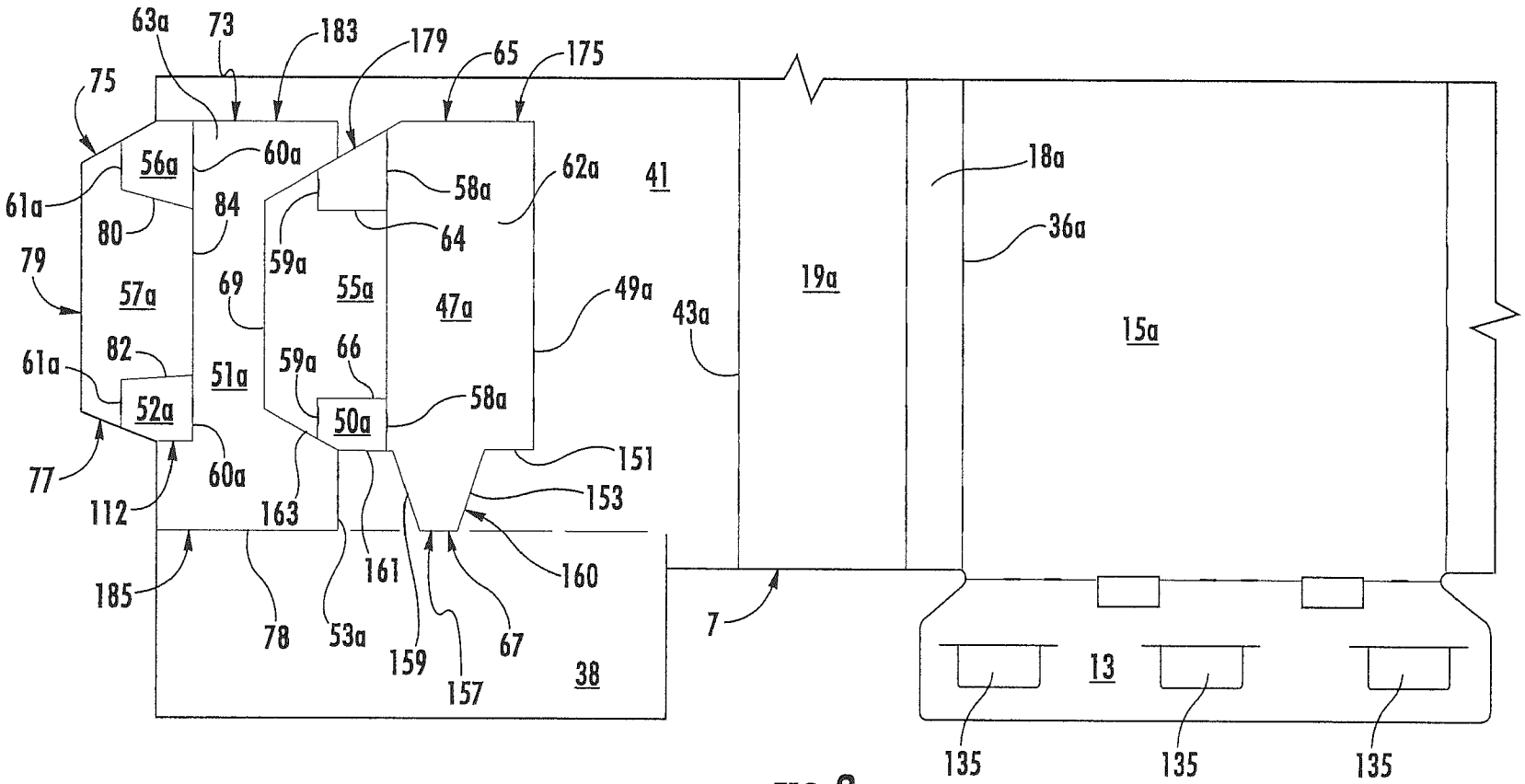
FIGS. 2 and 3 are detail views of the divider flaps according to one embodiment of the disclosure.

As shown in FIG. 2, the top cut 65 of the first divider flap 47*a* has generally straight portions forming respective straight edge portion 175 of the front central panel 41 and an oblique portion forming an edge portion 179 of the front central panel. The bottom cut 67 has straight portions forming respective edge portions 151, 157, 161 of the front central panel 41 and oblique portions forming respective edge portions 153, 159, 163 of the front central panel. The upper cut 73 of the second divider flap 51*a* has one generally straight portion forming an edge portion 183 of the front central panel 41. A lower cut 78 has one generally straight portion forming an edge portion 185 of the front central panel 41.

Figure 3:
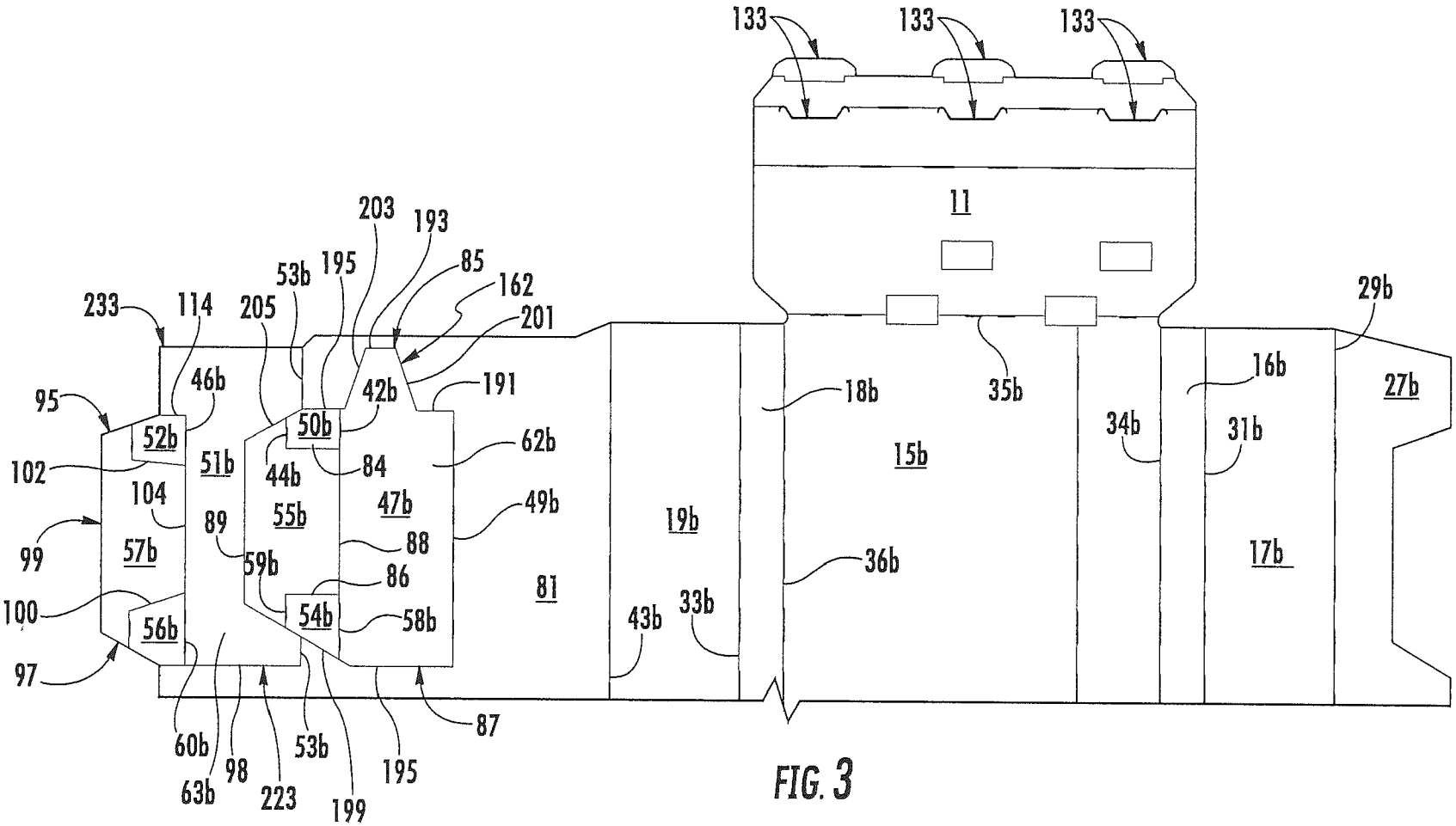

As shown in FIG. 3, the top cut 87 of the third divider flap 47*b* has generally straight portions forming respective straight edge portion 195 of the back central panel 81 and an oblique portion forming an edge portion 199 of the front central panel. The bottom cut 85 has straight portions forming respective edge portions 191, 193, 195 of the back central panel 81 and oblique portion forming an edge portion 201, 203, 205 of the front central panel. The upper cut 98 of the fourth divider flap 51*b* has one generally straight portion forming an edge portion 223 of the back central panel 81 and a lower edge portion 233 generally straight and defining the outer edge of the of the back central panel 81.

As illustrated in FIGS. 2 and 3, the edge portions 153, 157, and 159 of the first divider flap 47*a* has a heel separator 160 that extends downwardly and the edge portions 193, 195, and 201 of the first divider flap 47*b* have a heel separator 162 that extends downwardly to form a separation between the bottom sides of the container receiving openings when the carrier is formed from the blank. The shape of the top cuts 65, 105, the shape of the bottom cuts 67, 107 and the shape of the cuts 73, 113 form features of the blank 3 that facilitate forming of the carrier 5 from the blank. The first, second, third and fourth divider flaps 47*a*, 51*a*, 47*b*, 51*b* each have a first dimension D1 (FIG. 4) comprising the length of the respective main panel 62*a*, 62*b*, 63*a*, 63*b* and beveled portions 50*a*, 54*a*, 52*a*, 56*a*, 50*b*, 54*b*, 52*b*, 56*b* in the flat position (i.e., non-assembled position). The front portion 7 and the back portion 9 each have a second dimension D2 (FIG. 10) corresponding to the distance from the first and second central panels 41, 81 to the front panel 15*a* and the back panel 15*b*. The first dimension D1, corresponding to the length of the main panels 62*a*, 62*b*, 63*a*, 63*b* and beveled portions 50*a*, 54*a*, 52*a*, 56*a*, 50*b*, 54*b*, 52*b*, 56*b* in the flat or in the folded condition, is greater than the second dimension D2.

Any of the panels, flaps, fold lines, cuts, or other features could be otherwise shaped, arranged, and/or omitted from the blank 3 without departing from the disclosure. The blank 3 could be sized and/or shaped to accommodate more or less than six containers without departing from this disclosure.

Figure 4:
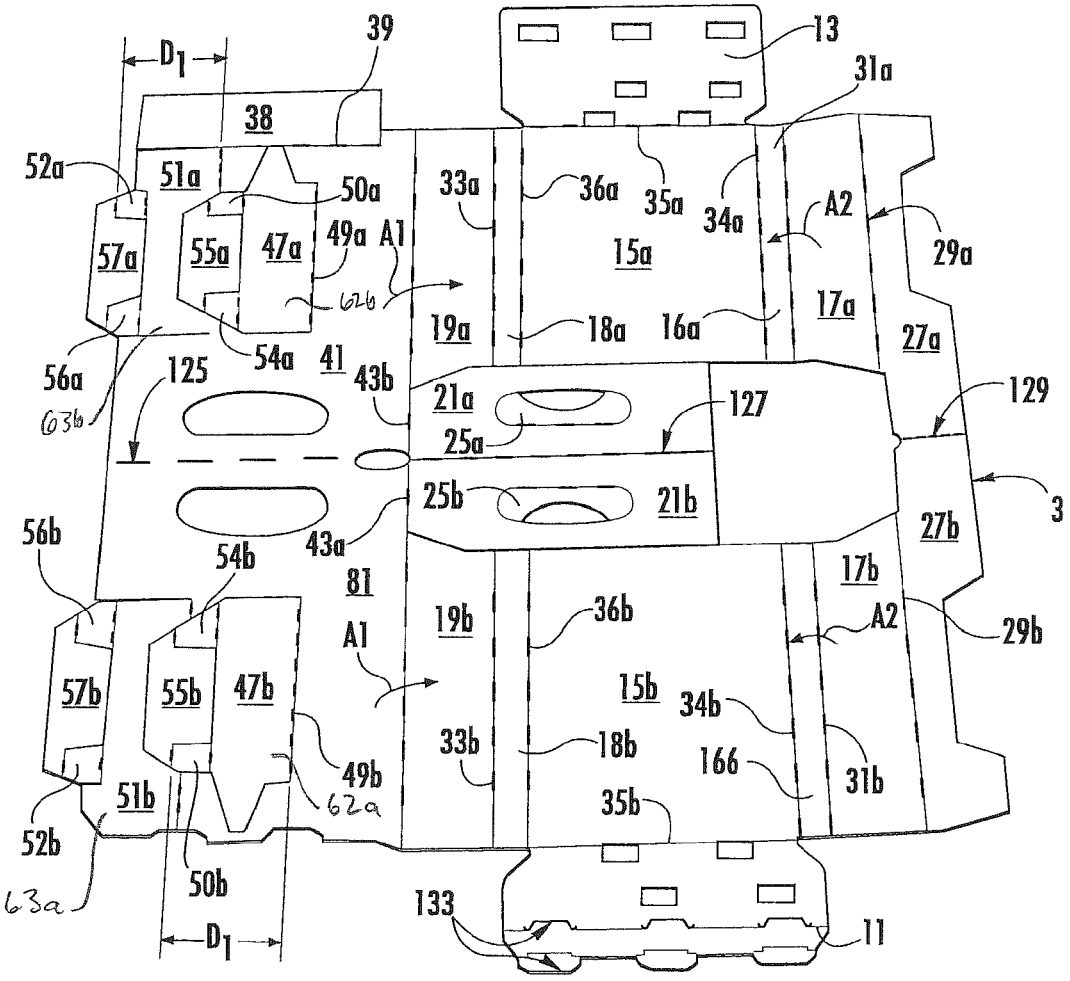
FIG. 4 is a perspective view of the interior of the carton blank of FIG. 1.
Figure 5:
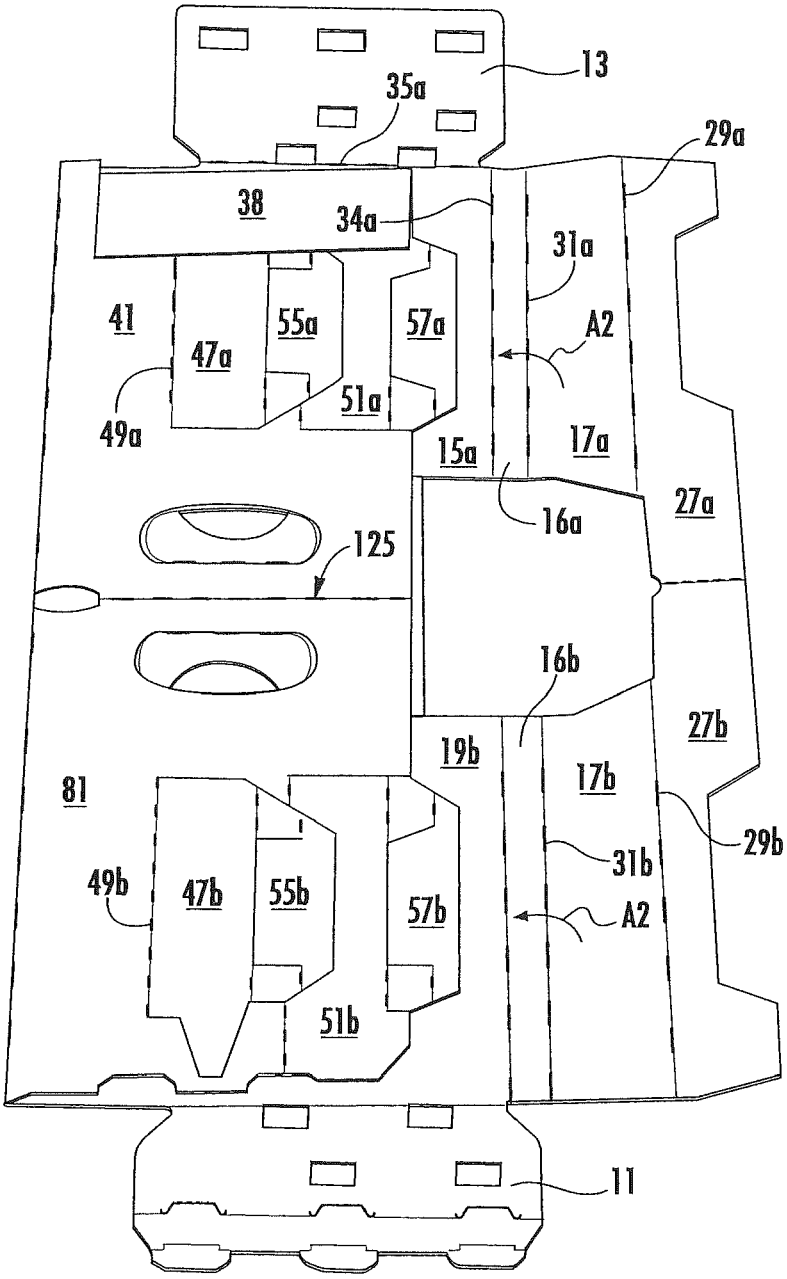
FIGS. 5 and 6 are views showing the folding of the carton blank to form a partially-erected carrier according to one embodiment of the disclosure.
Figure 6:
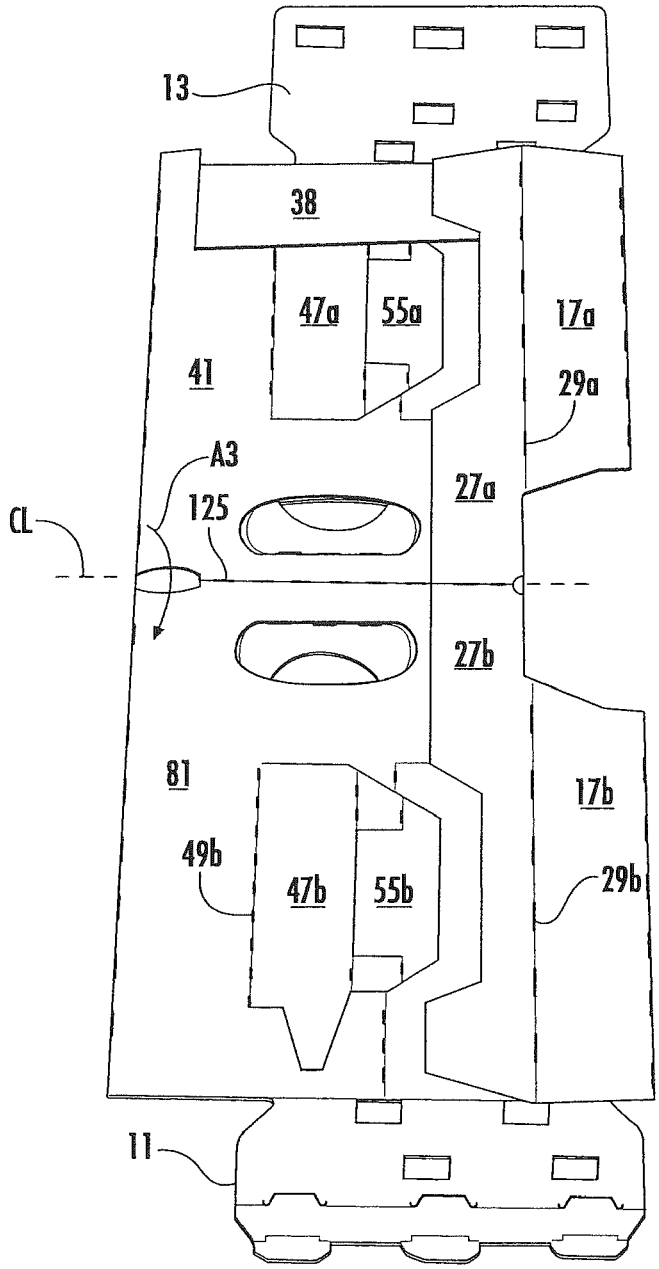
Figure 7:
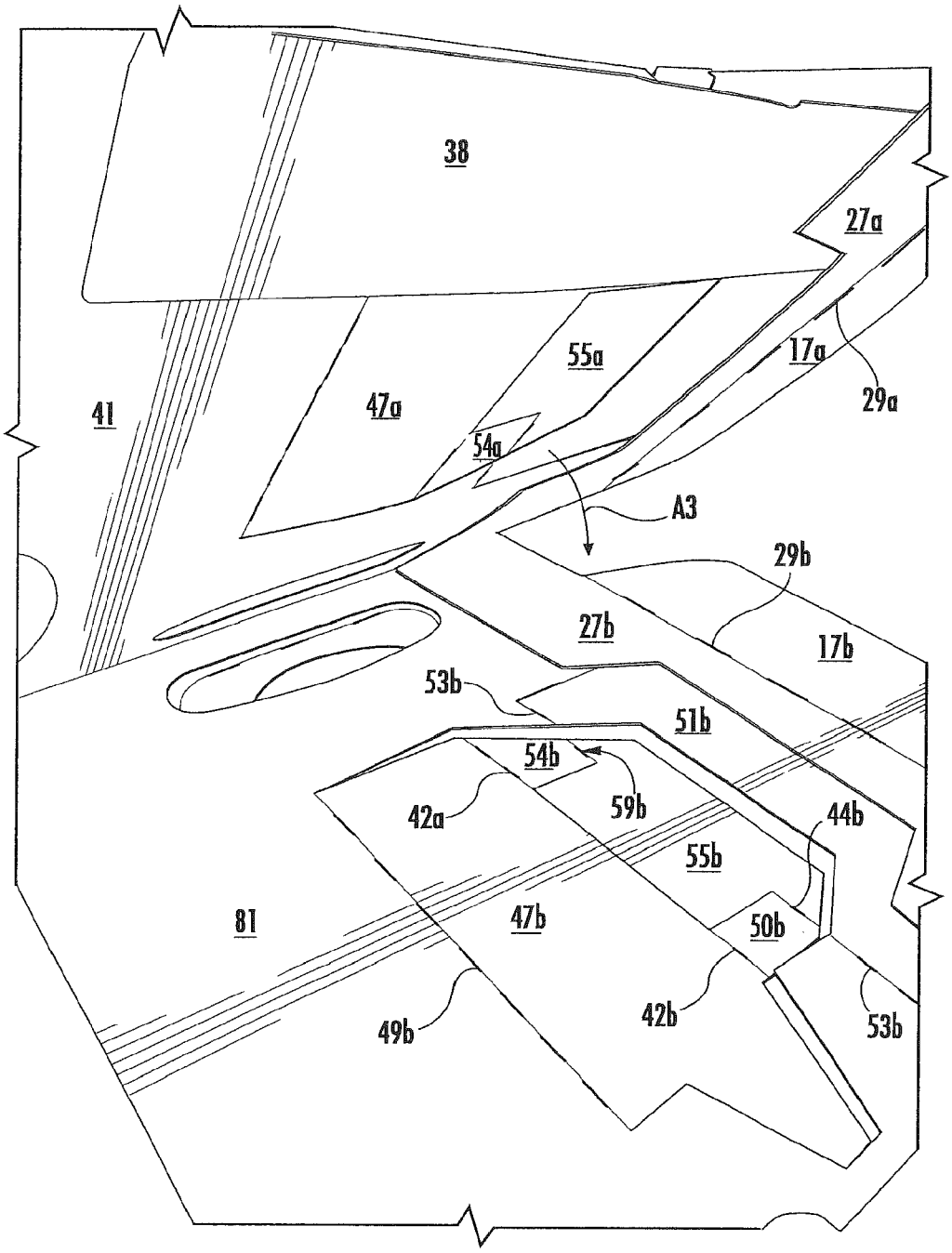
FIGS. 7 and 8 are views showing further folding of the partially-erected carrier of FIG. 6 into the carrier according to one embodiment of the disclosure.
Figure 8:
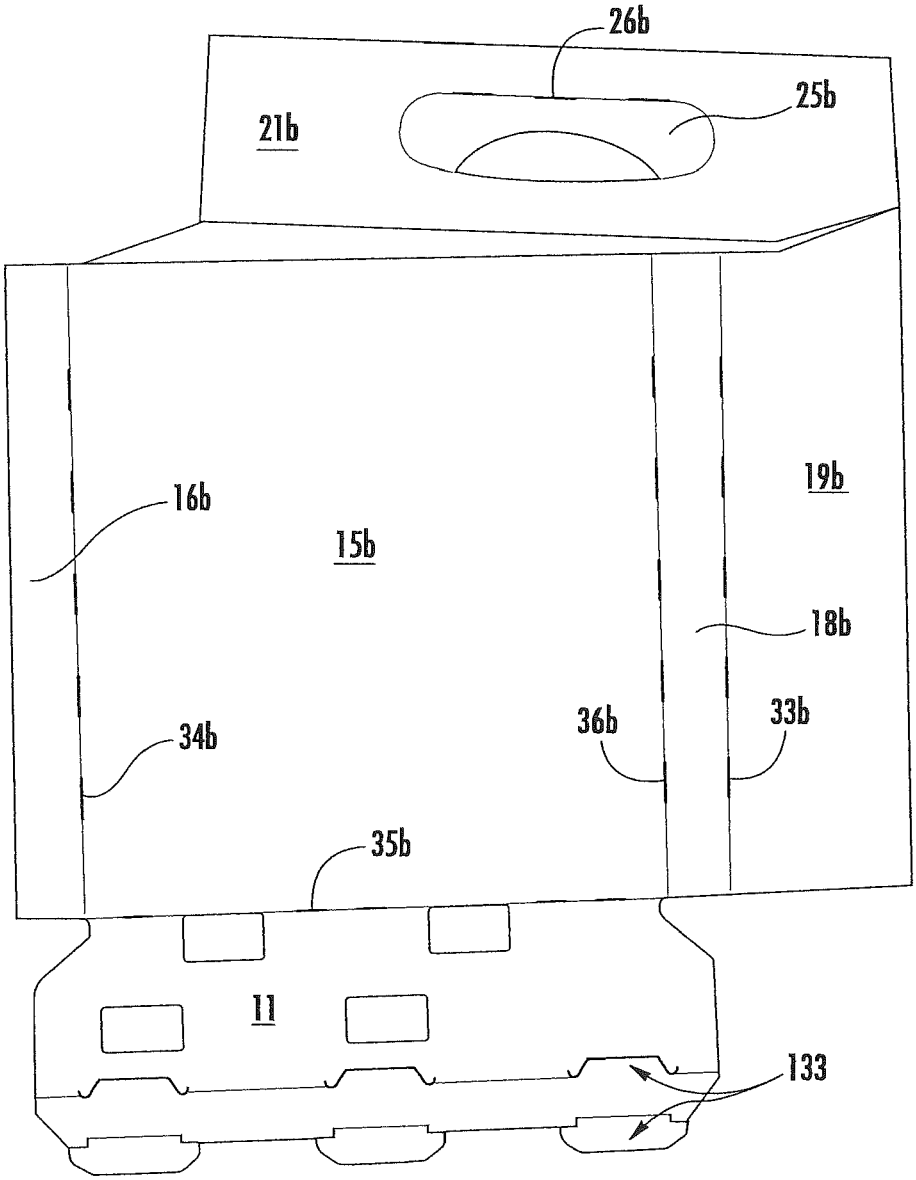

With reference to FIGS. 4-14, in one exemplary method of erection, the blank 3 is positioned with its exterior surface 1 facing down, as illustrated in FIG. 4. The carrier 5 may be erected from the blank 3 by respectively folding the central panels 41, 81 in the direction of arrows A1 about fold lines 43*a*, 43*b* so that the central panels are in face-to-face relationship with portions of the handle panels 21*a*, 21*b* and the front and back panels 15*a*, 15*b*. Glue or other adhesive is selectively applied to the blank 3 to adhesively connect the adhesive flaps 55*a*, 57*a* to the front panel 15*a* with glue and to adhesively connect the adhesive flaps 55*b*, 57*b* to the back panel 15*b*. Next, the keel 38 is folded about fold line 39 to be in face-to-face contact and adhesively connected with the exterior surface 1 of the central panel 41. Then, the side panels 17*a*, 17*b* are folded in the direction of arrows A2 about fold lines 31*a*, 31*b* so that the side panels 17*a*, 17*b* and central panel flaps 27*a*, 27*b* are in face-to-face contact with portions of the front and back panels 15*a*, 15*b*. Also, portions of the central panels 27*a*, 27*b* are in face-to-face contact with portions of the handle panels 21*a*, 21*b* and the central panels can be selectively adhesively secured thereto with glue.

Figure 9:
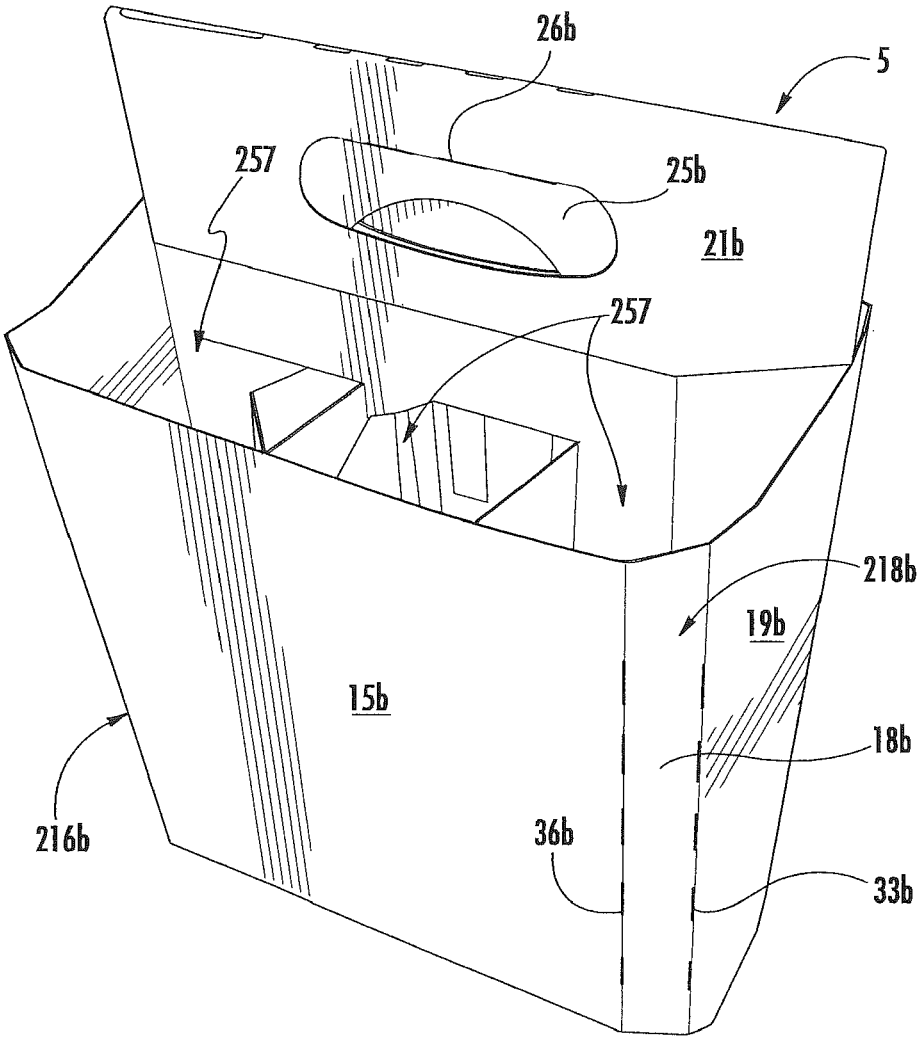
FIGS. 9 and 10 are perspective views of the exemplary basket-style carrier according to one embodiment of the disclosure.
Figure 11:
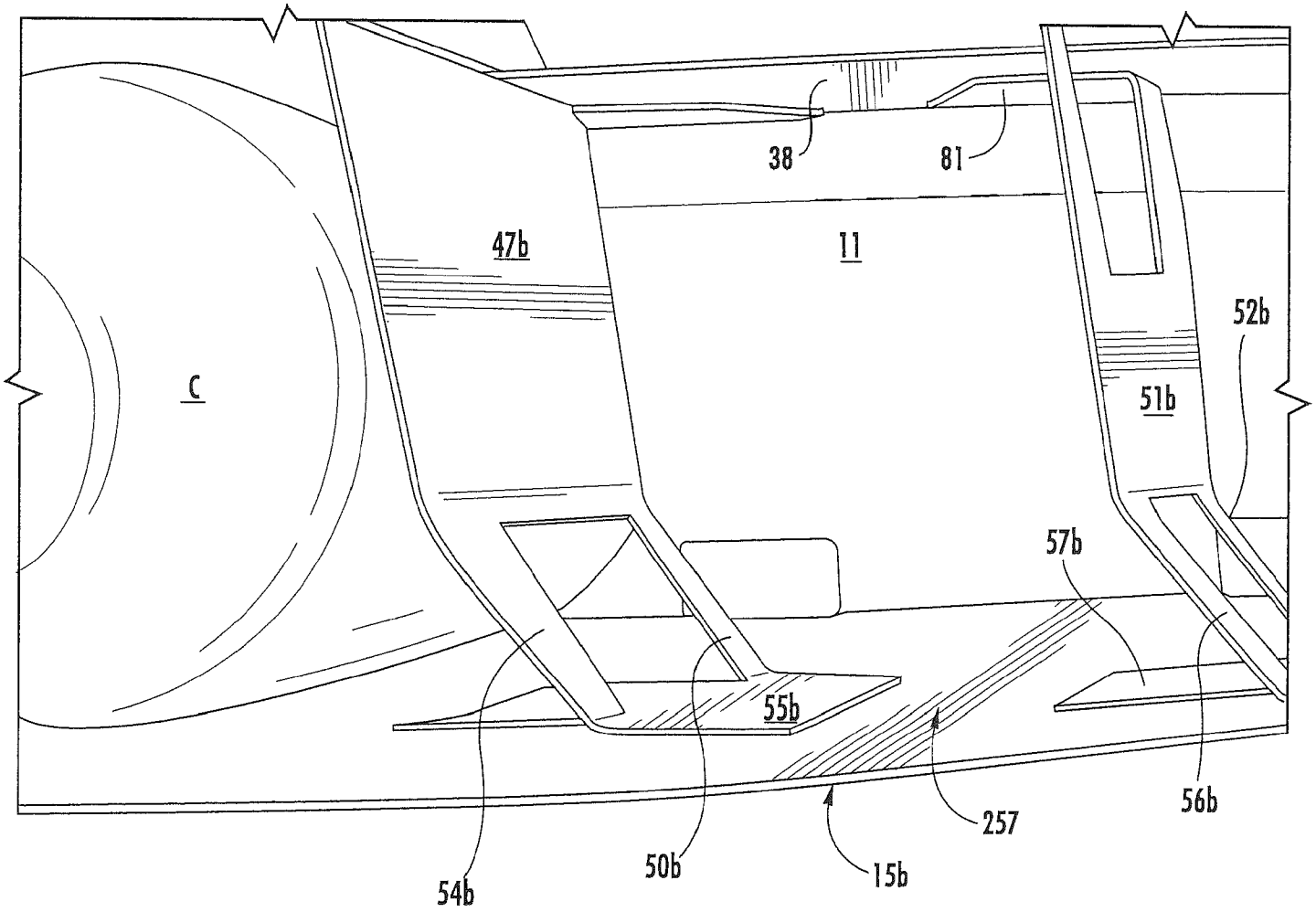
FIGS. 11 and 12 are detail views of a container receiving space according to one embodiment of the disclosure.
Figure 12:
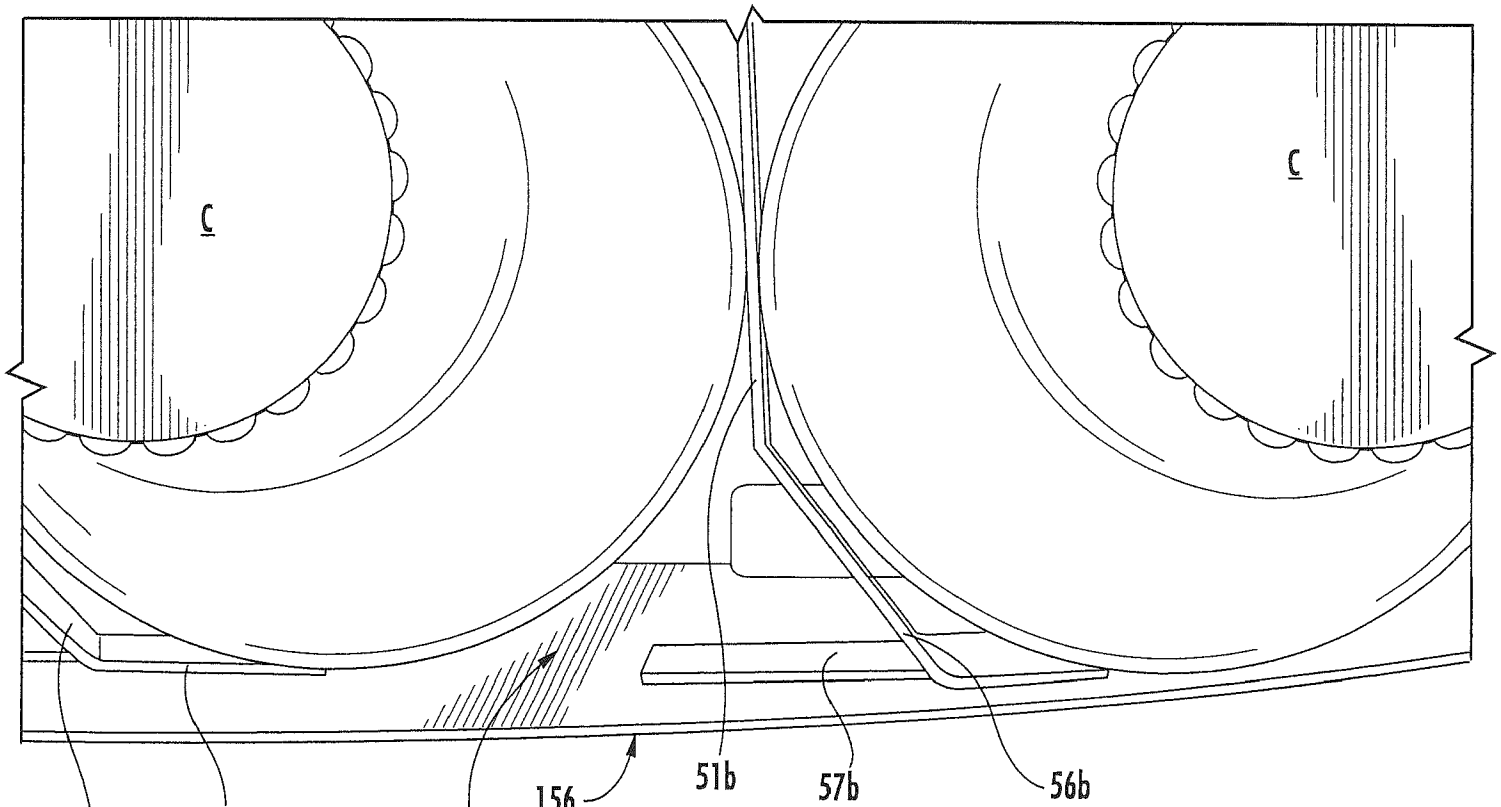

Next, the partially assembled blank 3 is folded in the direction of arrow A3 (FIGS. 6-7) about the longitudinal centerline CL so that the front portion 7 overlaps the back portion 9. The bottom panel 11 is attached to the bottom panel adhesive flap 13 by glue, or by mechanical attachment wherein the bottom panel 11 comprises locking portions 133 which interlock with openings 135. As shown in FIG. 9, the blank 3 is further assembled into the carrier by positioning the first side panels 17*a*, 17*b* and second side panels 19*a*, 19*b* to be in a generally spaced-apart, parallel planar relationship and positioning the front panel 15*a* and back panel 15*b* to be in a generally spaced-apart, parallel planar relationship. Such movement of the side panels 17*a*, 17*b*, 19*a*, 19*b* and front and back panels 15*a*, 15*b*, causes the corner panels 16*a*, 16*b*, 18*a*, 18*b*, to form beveled corners 216*a*, 216*b*, 218*a*, 218*b*, of the carton 5. As shown in FIGS. 10-12, further such movement of the side panels 17*a*, 17*b*, 19*a*, 19*b* and front and back panels 15*a*, 15*b*, causes the main panels 62*a*, 63*a* of the divider flaps 47*a*, 51*a* in the front portion of the carrier 5 to be positioned generally perpendicular with beveled portions 50*a*, 54*a*, 52*a*, 56*a* oblique to the main panels 62*a*, 63*a* and the front panel 15*a* to divide the front portion into three container-receiving spaces 255. Similarly, the rear portion of the carrier is divided into three container receiving spaces 257 by the main panels 62*b*, 63*b* of the divider flaps divider flaps 47*b*, 51*b* and beveled portions 50*b*, 54*b*, 52*b*, 56*b*. The beveled corners 216*a*, 216*b*, 218*a*, 218*b* and beveled portions 50*a*, 54*a*, 52*a*, 56*a*, 50*b*, 54*b*, 52*b*, 56*b* create container receiving spaces for increased product (e.g., glass) protection.

Containers can be placed into the spaces 255, 257 of the carrier 5. The bottoms of the containers are supported by the bottom walls 11, 13 of the carrier 5.

The exemplary carrier embodiment discussed above accommodates six containers arranged in two rows, but the present disclosure is not limited to these numbers. As one example, additional containers may be accommodated by increasing the size of the blank 3 (e.g., in the longitudinal direction L1 in FIG. 1) and forming additional container-receiving spaces therein. Also, the blank 3 could have less than six container-receiving spaces.

In general, the blank may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding thereal-ong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for holding a plurality of containers, the carrier comprising:

a plurality of panels that extends at least partially around an interior of the carrier, the panels comprising at least one bottom panel, a front panel, a back panel, and at least two side panels;

at least one central panel dividing the interior of the carrier into a front portion and a back portion; and at least one divider flap foldably attached to the at least one central panel and extending to one of the front panel and the back panel and spaced apart from the least two side panels to divide one of the front portion and the back portion into at least two container-receiving spaces, the at least one divider flap having a main panel foldably connected to the at least one central panel and at least one beveled portion foldably connected to the main panel and oblique to the main panel, the at least one divider flap comprises an attachment flap foldably connected to the at least one beveled portion, the attachment flap being in face-to-face contact with the one of the front panel and the back panel.

2. The carrier of claim 1, wherein the at least one beveled portion comprises a first beveled portion and a second beveled portion.

3. The carrier of claim 2, wherein the at least one central panel and the one of the front panel and the back panel are generally parallel, the main panel is generally perpendicular to the central panel and the one of the front panel and the back panel, and the first beveled portion and the second beveled portion are oblique relative to the main panel, the at least one central panel, and the one of the front panel and the back panel.

4. The carrier of claim 1, wherein the at least one divider flap comprises a first divider flap and a second divider flap and the at least two container-receiving spaces comprise three container receiving spaces.

5. The carrier of claim 4, wherein the first divider flap and the second divider flap extend from the at least one central panel to the front panel and the three container-receiving spaces are front container-receiving spaces, the at least one divider flap comprises a third divider flap and a fourth divider flap each extending from the at least one central panel to the back panel to divide the back portion of the carrier into back container-receiving spaces.

6. The carrier of claim 1, wherein at least one of the front panel and the back panel is foldably connected to a first corner panel and a second corner panel, the first corner panel and the second corner panel are foldably connected to a respective one of the at least two side panels, the first corner panel and the second corner panel form a respective beveled corner of the carrier.

7. The carrier of claim 6, wherein the at least one bottom panel comprises at least two beveled edges, each of the beveled edges cooperate with a respective first corner panel and second corner panel to form a respective beveled corner of the carton.

8. The carrier of claim 1, wherein the at least one divider flap has a first dimension comprising a length of the main panel and the beveled portion, the one of the front portion and the back portion has a second dimension corresponding to the distance from the at least one central panel to the one of the front panel and the back panel, the first dimension being greater than the second dimension.

9. The carrier of claim 8, wherein the attachment flap is foldably connected to the at least one beveled portion at a fold line, the first dimension extends from the central panel to the fold line.

10. The carrier of claim 1, wherein the attachment flap comprises a free edge of the divider flap.

11. A blank for forming a carrier for holding a plurality of containers, the blank comprising:

a plurality of panels, the plurality of panels comprising at least one bottom panel, a front panel, a back panel, and at least two side panels;

at least one central panel configured to divide the interior of the carrier into a front portion and a back portion when the carrier is formed from the blank; and at least one divider flap foldably attached to the at least one central panel and configured to extend to one of the front panel and the back panel and be spaced apart from the at least two side panels to divide one of the front portion and the back portion into at least two container-receiving spaces when the carrier is formed from the blank, the at least one divider flap having a main panel foldably connected to the at least one central panel, at least one beveled portion foldably connected to the main panel and oblique to the main portion panel when the carrier is formed from the blank, at least one divider flap comprises an attachment flap foldably connected to the at least one beveled portion, the attachment flap is configured to be in face-to-face contact with the one of the front panel and the back panel when the carrier is formed from the blank.

12. The blank of claim 11, wherein the at least one beveled portion comprises a first beveled portion and a second beveled portion.

13. The blank of claim 12, wherein the at least one central panel and the one of the front panel and the back panel are configured to be generally parallel, the main panel is configured to be generally perpendicular to the central panel and the one of the front panel and the back panel, and the first beveled portion and the second beveled portion are configured to be oblique relative to the main panel, the at least one central panel, and the one of the front panel and the back panel when the carrier is formed from the blank.

14. The blank of claim 11, wherein the at least one divider flap comprises a first divider flap and a second divider flap.

15. The blank of claim 14, wherein the first divider flap and the second divider flap are configured to extend from the at least one central panel to the front panel when the carrier is formed from the blank, and the at least two container-receiving spaces are front container-receiving spaces, the at least one divider flap comprises a third divider flap and a fourth divider flap each configured to extend from the at least one central panel to the back panel to divide the back portion of the carrier into back container-receiving spaces when the carrier is formed from the blank.

16. The blank of claim 11, wherein at least one of the front panel and the back panel is foldably connected to a first corner panel and a second corner panel, the first corner panel and the second corner panel are foldably connected to a respective one of the at least two side panels, the first corner panel and the second corner panel form a respective beveled corner of the carrier when the carrier is formed from the blank.

17. The blank of claim 16, wherein the at least one bottom panel comprises at least two beveled edges, each of the beveled edges are configured to cooperate with a respective first corner panel and second corner panel to form a respective beveled corner of the carrier when the carrier is formed from the blank.

18. The blank of claim 11, wherein the at least one divider flap has a first dimension comprising a length of the main panel and the beveled portion, the one of the front portion and the back portion has a second dimension corresponding to the distance from the at least one central panel to the one of the front panel and the back panel when the carrier is formed from the blank, the first dimension being greater than the second dimension.

19. The blank of claim 11, wherein the attachment flap comprises a free edge of the divider flap.

20. A method of forming a carrier for holding a plurality of containers, the method comprising:

obtaining a blank comprising at least one bottom panel, a front panel, a back panel, at least two side panels, at least one central panel, and at least one divider flap foldably attached to the at least one central panel, the at least one divider flap having a main panel foldably connected to the at least one central panel, at least one beveled portion foldably connected to the main panel, and an attachment flap foldably connected to the at least one beveled portion;

forming the interior, dividing the interior into a front portion and a back portion with the at least one central panel, dividing one of the front portion and the back portion into at least two container receiving spaces by positioning the at least one divider flap so that the at least one divider flap extends to a respective one of the front and back panels and is spaced apart from the at least two side panels; and positioning the attachment flap in face-to-face contact with the one of the front panel and the back panel.

21. The method of claim 20, wherein the at least one beveled portion comprises a first beveled portion and a second beveled portion.

22. The method of claim 21, wherein the at least one central panel and at least one of the front panel and the back panel are generally parallel, the main panel is generally perpendicular to the at least one central panel and at least one of the front panel and the back panel; and the first beveled portion and the second beveled portion are oblique relative to the main panel, the at least one central panel, and at least one of the front panel and the back panel.

23. The method of claim 20, wherein the at least one divider flap comprises a first divider flap and a second divider flap and the at least two container-receiving spaces comprise three container receiving spaces.

24. The method of claim 23, wherein the first divider flap and the second divider flap extend from the at least one central panel and the three container-receiving spaces are front container-receiving spaces, the at least one divider flap comprises a third divider flap and a fourth divider flap, the method further comprising extending the third divider flap and the fourth divider flap from the at least one central panel to the back panel to divide the back portion of the carrier into back container-receiving spaces.

25. The method of claim 20, wherein at least one of the front panel and the back panel is foldably connected to a first corner panel and a second corner panel, the first corner panel and the second corner panel are foldably connected to a respective one of the at least two side panels, and the at least one bottom panel comprises at least two beveled edges; the method further comprises positioning the first corner panel and second corner panel adjacent a respective one of the at least two beveled edges to form a respective beveled corner of the carrier.

26. The method of claim 20, wherein the at least one divider flap has a first dimension comprising a length of the main panel and the beveled portion, the one of the front portion and the back portion has a second dimension corresponding to the distance from the at least one central panel to the one of the front panel and the back panel, the first dimension being greater than the second dimension.

27. The method of claim 20, wherein the attachment flap comprises a free edge of the divider flap.

* * * * *